US010919312B2

(12) United States Patent
Greger et al.

(10) Patent No.: US 10,919,312 B2
(45) Date of Patent: Feb. 16, 2021

(54) METHOD AND DEVICE FOR PRINTING TO A RECORDING MEDIUM WITH A COATING SUBSTANCE, AND CORRESPONDING PRINTING SYSTEM

(71) Applicant: Océ Holding B.V., Venlo (NL)

(72) Inventors: Oliver Greger, Munich (DE); Walter Brenner, Oberding (DE); Michael Pohlt, Munich (DE); Anna-Karin Eriksson, Poing (DE); Rainer Jäger, Hallbergmoos (DE); Christoph Soldner, Munich (DE)

(73) Assignee: Canon Production Printing Holding B.V., Venlo (NL)

( * ) Notice: Subject to any disclaimer, the term of this patent is extended or adjusted under 35 U.S.C. 154(b) by 0 days.

(21) Appl. No.: 16/253,532

(22) Filed: Jan. 22, 2019

(65) Prior Publication Data

US 2019/0224985 A1 Jul. 25, 2019

(30) Foreign Application Priority Data

Jan. 22, 2018 (DE) ..... 10 2018 101 295

(51) Int. Cl.

| | |
|---|---|
| ***B41J 2/21*** | (2006.01) |
| ***B41M 5/00*** | (2006.01) |
| ***B41J 11/00*** | (2006.01) |
| ***B41J 2/165*** | (2006.01) |

(52) U.S. Cl.

CPC ..... *B41J 2/2114* (2013.01); *B41J 2/165* (2013.01); *B41J 2/2132* (2013.01); *B41J 11/002* (2013.01); *B41J 11/0015* (2013.01); *B41M 5/0017* (2013.01); *B41J 2202/21* (2013.01)

(58) Field of Classification Search

CPC ..... B41J 2/155; B41J 2/01; B41J 2/07; B41J 2/16585; B41J 2/21; B41J 2/2114; B41J 11/001; B41J 11/0015; B41J 2002/16591

See application file for complete search history.

(56) References Cited

U.S. PATENT DOCUMENTS

| | | | | |
|---|---|---|---|---|
| 5,880,759 | A * | 3/1999 | Silverbrook | B41J 2/005 347/48 |
| 7,207,650 | B2 * | 4/2007 | Ikemoto | B41J 2/04543 347/42 |
| 8,096,631 | B2 * | 1/2012 | Kunimatsu | B41J 2/04528 347/9 |

(Continued)

OTHER PUBLICATIONS

German action dated Oct. 26, 2018 in Application No. 10 2018 101 295.0.

*Primary Examiner* — John Zimmermann
(74) *Attorney, Agent, or Firm* — Schiff Hardin LLP

(57) ABSTRACT

In a method for preventing or reducing air vortex formation between a print plate and a recording medium upon printing to the recording medium with a coating substance (e.g. primer), the recording medium is provided at a feed velocity of at least 20 meters per minute, and a plurality of print nozzles of a print head are alternately activated to print the coating substance on recording medium to cover a surface of the recording medium with the coating substance. The activation can include only activating a portion of the plurality of print nozzles simultaneously. Further, a predetermined applied quantity of the coating substance per area is constantly printed onto the recording medium.

19 Claims, 3 Drawing Sheets

(56) References Cited

U.S. PATENT DOCUMENTS

| | | | | |
|---|---|---|---|---|
| 2004/0095422 | A1* | 5/2004 | Eguchi | B41J 2/155<br>347/42 |
| 2004/0109035 | A1* | 6/2004 | Otokita | B41J 2/17566<br>347/5 |
| 2006/0055714 | A1* | 3/2006 | Kuwahara | B41J 2/04505<br>347/5 |
| 2008/0246789 | A1* | 10/2008 | Carlson | B41J 29/13<br>347/13 |
| 2013/0128286 | A1* | 5/2013 | Tamagawa | G06K 15/02<br>358/1.2 |
| 2013/0249985 | A1* | 9/2013 | Marcus | B41J 2/09<br>347/10 |
| 2015/0029264 | A1* | 1/2015 | North | B41J 2/01<br>347/43 |
| 2015/0360254 | A1 | 12/2015 | Moribe et al. | |
| 2017/0129237 | A1* | 5/2017 | Arakane | B41J 2/2135 |
| 2017/0157922 | A1* | 6/2017 | Zhao | B41J 2/1433 |
| 2018/0009245 | A1 | 1/2018 | Sasaki | |

* cited by examiner

METHOD AND DEVICE FOR PRINTING TO A RECORDING MEDIUM WITH A COATING SUBSTANCE, AND CORRESPONDING PRINTING SYSTEM

CROSS REFERENCE TO RELATED APPLICATIONS

This patent application claims priority to German Patent Application No. 102018101295.0, filed Jan. 22, 2018, which is incorporated herein by reference in its entirety.

BACKGROUND

The disclosure relates to a method for printing to a recording medium with a coating substance, in particular a primer; a device for printing to a recording medium with a coating substance, in particular a primer; and a printing system for continuous printing to a recording medium with a primer.

The print quality is one of the most important factors in the field of colored inkjet printers. Since the printed image of an inkjet printer is formed by thousands of individual ink droplets (print on demand), the quality of the image is ultimately dependent on the quality of each ink droplet and the arrangement of the ink droplets on the print medium.

The problem which negatively affects the quality of printed images is a lack of contour sharpness. In an ideal environment, ink droplets form a perfect circle of uniform size when they are applied onto a medium or recording medium. Colored inks typically run into their surroundings (both in width and in depth) when they are applied onto a medium. This is also referred to as bleeding. If the surroundings do not contain ink, the resulting image does not have precisely demarcated edges. If another ink droplet is present in the surroundings, the two ink droplets join in an unwanted manner. If ink droplets even have different colors, a different, unwanted color may thus be produced by the unwanted combination.

An additional general problem that negatively affects the printed image results from the slow drying of the ink. After the printing of one side has ended, the printer would need to hold the side, for example for a predetermined amount of time, so that the ink can dry before it could print to the back side.

This problem may be countered via the use of fixing agents or fixatives (also referred to as primers or also colorless ink). Primers are typically colorless, bind the colored ink with the recording medium, and prevent the colored ink from being drawn deep into the recording medium. Instead of this, the primer fixes the colored ink (typically cyan, magenta, yellow, and black) on the surface of the recording medium. The precision of the edge is thereby improved, and the drying speed of the individual colored inks is increased.

Given web printing, meaning that the recording medium is rolled up on a roll that is typically of 400 to 800 mm in width, the primer is applied onto the recording medium before the actual printing of the colored ink.

The primer is continuously applied onto the recording media—which are still dry up to this point—by means of at least one inkjet print head. After the primer application, the recording medium is humidified and, still in the damp state, at least one of the colored inks is then applied by means of multiple inkjet print heads. The still-dry recording medium—for example uncoated paper—thus first passes the primer print bar. Given uncoated paper, the surface of the paper is unsmoothed and also exposed. Therefore, paper fibers may easily detach from the uncoated paper in particular, which paper fibers may deposit as dust on at least one of the primer nozzle plates over the printing time. This occurs in particular given full-surface primer application.

The dust deposits on the printing plate represent one cause for nozzle failures of a primer print head. Degradations of the print quality may therefore be incurred, for example due to colors running into one another (what is known as "bleeding"), non-uniform drying of the colored ink, or the like. Therefore, until now cleaning systems for paper web cleaning, for example air flow-based web cleaning systems, have often been used in advance of a primer inkjet station in order to thus remove loose paper dust from the substrate before the printing. However, the disadvantage in this is a quite complicated and cost-intensive cleaning device.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

Figure 1:
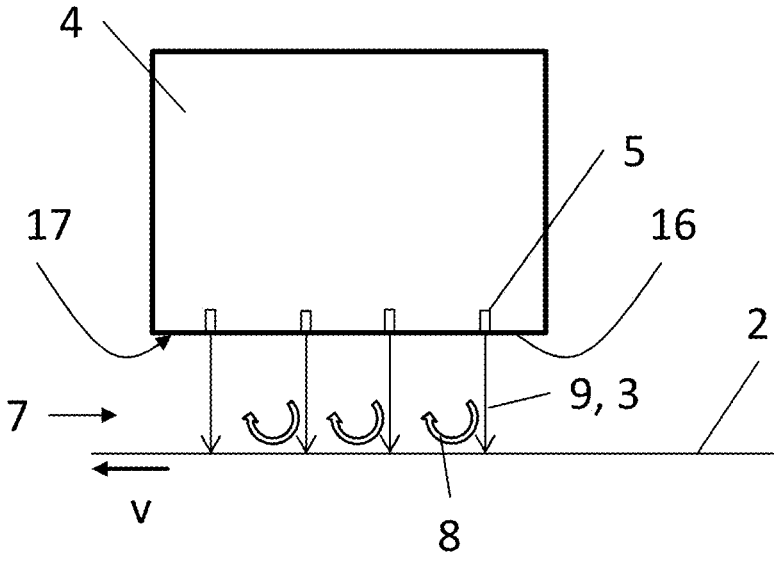
FIG. 1 illustrates a schematic diagram of a printer and the process of printing to a recording medium with a coating substance, having essentially stationary flow conditions.

The exemplary embodiments of the present disclosure will be described with reference to the accompanying drawings. Elements, features and components that are identical, functionally identical and have the same effect are—insofar as is not stated otherwise—respectively provided with the same reference character.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure.

An object of the present disclosure is to provide an improved method and a corresponding device for printing to a recording medium with a coating substance to reduce the contamination of a print head due to deposits of pollutant particles.

Although embodiments of the disclosure are described with references to using a primer print head, the disclosure is not limited thereto, and can also be transferred to full-surface color printing, for example.

This disclosure relates to a method for preventing (or at least reducing) air vortex formation between a print plate and a dust-producing recording medium, in particular an uncoated paper, upon printing to the recording medium with a coating substance, in particular a primer, wherein a feed velocity of the recording medium of at least 20 meters per minute is provided; a plurality of print nozzles of a print head is alternately activated for surface-covering printing of the coating substance, wherein only a portion of the print nozzles is ever activated simultaneously; and wherein a predetermined constant applied quantity of the coating substance per area is printed onto the recording medium.

The disclosure also relates to a device for preventing air vortex formation between a print plate and a dust-producing recording medium, in particular an uncoated paper, upon printing to the recording medium with a coating substance, in particular a primer, with: a print head which has a plurality of individually addressable print nozzles; a controller for controlling the individual print nozzles, wherein the controller is formed and configured to control the print nozzles for surface-covering printing of the coating substance onto the recording medium, in particular according to a method according to the disclosure, to prevent air vortex formation, such that the print nozzles can be activated in alternation, only a portion of the print nozzles can ever be activated simultaneously, and a predetermined applied quantity of coating substance per area can be constantly applied onto the recording medium.

The disclosure additionally relates to a corresponding printing system for continuous printing to a recording medium with a primer, with: a conveyor which is designed to continuously convey the recording medium with a feed velocity of at least 20 meters per minute; and a primer inkjet station for continuous printing to the recording medium with a predetermined applied quantity of the primer per area, wherein the primer inkjet station has a primer printer according to the disclosure and/or is designed to implement a method according to the disclosure.

Given a continuous printing process with constant nozzle activity and feed velocities of at least 20 meters per minute, vortices that are excited in a fluid-dynamic manner by the nearly stationary print jet arise in the print gap between recording medium and print head or print plate. Such vortices may transport pollutant particles and/or dust from the recording medium to the print plate if the recording medium is dusty or itself gives off dust particles. This is especially relevant given printing to uncoated papers which, in the dry state, meaning before the application of a coating substance, quite strongly give off dust as compared with coated papers.

A uniform, surface-covering application of a coating substance, in particular for pre-treatment of the recording medium, may be applied with a large droplet size in a quality that is equivalent to those applied with a small droplet size; especially, in contrast to colored ink, a coating substance is also allowed to bleed on the recording medium. With an equivalent quality, the applied quantity of coating substance per area is the same at every location of the recording medium over the width and length of the pre-treated region, meaning that the applied quantity fluctuates only by a small tolerance range.

Exemplary embodiments of the disclosure produce a reduction of deposits at the print plate due to air vortex reduction by reducing and alternating the print nozzles that are to be activated given surface-covering printing. In this way, few stationary conditions appear in the print gap thereby counteracting a vortex formation. Fewer pollutant or dust particles are thus raised from the recording medium. Fewer particles also accordingly arrive at the nozzle plate.

To achieve the desired applied quantity per area for the surface-covering printing of the coating substance, which is also referred to as a surface allocation or surface coverage, an enlargement of the droplets emitted by the print nozzles may preferably be provided, which is harmless given the increase is directed to a coating substance.

However, the quantity of the deposits on the nozzle plate is also dependent on the proportion of the simultaneously active print nozzles that are in use. The more print nozzles that are active or "jet", the sooner that local conditions appear in which vortices arise, and the more deposits that consequently arrive at the nozzle plate. Advantageously, an increase in the droplet size may therefore additionally decrease the proportion of simultaneously active print nozzles because fewer simultaneously active print nozzles are therefore needed to provide the desired applied quantity. With fewer simultaneously active print nozzles, a more varied alternation of active print nozzles is in turn possible, which additionally contributes to transient flow conditions and thus to the prevention of vortices.

According to exemplary embodiments of the disclosure, an air vortex formation, and thus a dusting or contamination of the nozzle plate upon surface-covering printing of the coating substance, are thus reduced via a novel adaptation of the process parameters and also a novel, alternating manner of the activation of the print nozzles, which prevents nozzle failures and thus ensures the desired print quality over the long term.

A surface-covering printing relates to a predetermined area of the recording medium which should be entirely printed to with the coating substance. For example, it may thereby be an entire print region of the recording medium, which smaller predetermined areas may also be provided, however, for example over the width of a print head or of a print head segment.

The embodiments and developments of the present disclosure can be arbitrarily combined as would be understood by one of ordinary skill in the art based on the teachings herein. In particular, all features of the method for printing to a recording medium with a coating substance are also transferrable to a device for printing to a recording medium with a coating substance, as well as to a corresponding printing system, and vice versa.

Additional possible embodiments, developments, and implementations of the disclosure also comprise combinations, which are not explicitly cited, of features of the disclosure that have been described previously or are described in the following with regard to the exemplary embodiments. In particular, the person skilled in the art will also add individual aspects as improvements or additions to the respective basic form of the present disclosure.

FIG. 1 shows a schematic depiction of a print head 4 a process for printing to a recording medium 2 with a coating substance 3, with essentially stationary flow conditions.

It is an inkjet printing process for which an inkjet print head 4 is used. The recording medium 2 is, for example, uncoated paper, which is comparably dusty, in particular as a result of loose fibers located thereon.

The print head 4 has a plurality of print nozzles 5 which are provided in a nozzle plate 16 arranged on the underside 17 of the print head 4. The underside 17 of the print head 4 may thereby represent a nozzle plate 16. Here, four individual print nozzles 5 are shown in a purely schematic manner, wherein a print head 4 normally actually has a very high number of print nozzles 5. The diameter of the print nozzles may be in a range from 5 μm to 50 μm.

A recording medium 2 travels along with a constant feed velocity v of at least 20 meters per minute, with a predetermined print gap 7 below the nozzle plate or the print nozzles 5. The print nozzles 5 may thereby be constantly active. Coating substance 3 is typically applied with a smallest possible droplet size, which may be a volume of approximately 3 pl, for example.

The coating substance 3 is a fluid for coating the recording medium. In an exemplary embodiment, the coating substance 3 is a primer.

The number of active nozzles conforms to the desired applied quantity per area on the recording medium, which is also referred to as a surface allocation or surface coverage.

In this example, 100% of the schematically depicted nozzles are continuously active in order to print the desired constant applied quantity per area, for example 0.4 to 2.3 $g/m^2$ of coating substance, onto the recording medium at the set smallest possible droplet size. Naturally, other predetermined applied quantities, for example in a range between 0.1 and 3.8 $g/m^2$, are also conceivable depending on the type and composition of the recording medium. The range does not indicate that the applied quantity on the recording medium is variable, but rather that the applied quantity is selected from this range and then is to be maintained for the entire pretreated surface.

Such a print head 4 may apply an identical applied quantity of fluid with similar application density (liquid quantity per area) with different settings. For example, this may be achieved with different droplet sizes and a different number of active print nozzles. In particular given a uniform surface coverage with a colored ink, a smallest possible droplet size is normally selected in order to always keep a largest possible number of print nozzles active in order to thus avoid a clogging of the print nozzles and/or a streaking of the application.

According to the fluid mechanics according to Bernoulli and Venturi, the jets 9 of coating substance 3 that continuously stream from the print nozzles 5 also continuously accelerate the surrounding air. In this way, a certain air flow appears along the jets 9 which, in particular upon striking the recording medium, leads to a vortex formation in the print gap 7. In FIG. 1, this is schematically illustrated with corresponding curved arrows symbolizing the vortices 8. This may even develop into a stationary cylinder vortex. This means that the cylinder vortex may extend up to the entire width of the recording medium (see FIG. 3).

Such vortices 8 are capable of swirling up the dust and/or contaminant particles from the recording medium 2 and transporting them to the nozzle plate 16 or to the print nozzles 5. Deposits thus form there which in turn represent a seed for droplet formation, and thus a cause for nozzle failures of the print head 4.

Figure 2:
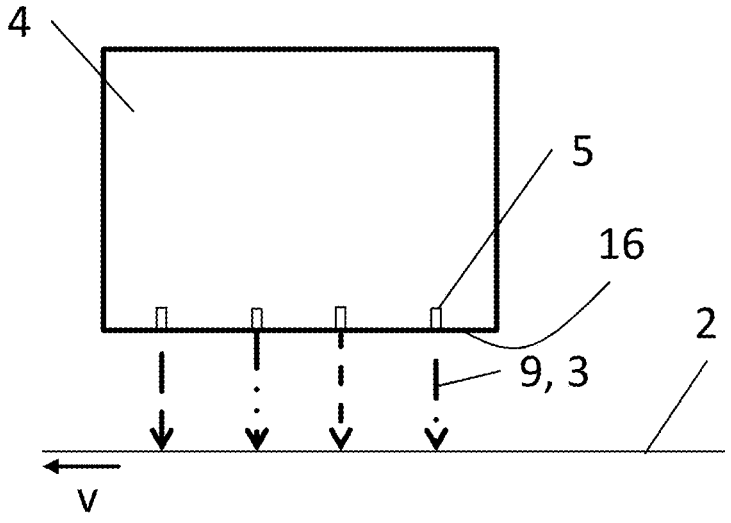
FIG. 2 illustrates a schematic diagram of a printer and the process of printing to a recording medium according to an exemplary embodiment of the present disclosure.

FIG. 2 shows a schematic depiction of a print head 3 and the process of printing to a recording medium 2 according to an exemplary embodiment of the present disclosure.

In an exemplary embodiment, the effect of the vortex formation between the print plate 16 and the recording medium 2 is avoided via an alternation of active print nozzles 5. For example, this may be intended as only every even print nozzle 5. In an exemplary embodiment, in combination or as an alternative, every even print nozzle 5 may be activated in a defined time interval, and then every odd print nozzle 5 may be activated for a defined time interval. These nozzles 5 are then activated in alternation. For this, the print nozzles 5 are individually addressable according to one or more exemplary embodiments. All print nozzles 5 are thus never simultaneously active. In an exemplary embodiment, a larger droplet size is also provided in comparison to the example shown in FIG. 1. In particular, a portion of the theoretically possible parameter field of the print head is thus truncated, for example a portion that has more than 80% nozzle activity and preferably also a portion that has the smallest droplet size. In an exemplary embodiment, a largest available droplet size is particularly used so that an optimally small portion of the print nozzles is simultaneously active, and thus a maximum alternation of active print nozzles can be set.

In an exemplary embodiment, the alternation of the print nozzles 5 is controlled statistically or stochastically. In this way, unwanted patterns (e.g. Moiré effects) may be advantageously avoided. The alternation is symbolized in FIG. 2 with the different intermittent jets 9 of the coating substance 3. Here, it is apparent that all five of the print nozzles 5 are never simultaneously active. Rather, in an exemplary embodiment, only 50% of the print nozzles 5 are active.

In an exemplary embodiment, for printing to the recording medium 2 with the coating substance (e.g. a primer), a plurality of print nozzles 5 of the print head 4 is thus activated in alternation for continuous printing of the coating substance 3 onto the recording medium 2. In this embodiment, only a portion of the print nozzles 5 of the print head 4 are simultaneously activated, and a predetermined applied quantity of coating substance 3 per area is constantly printed onto the recording medium 2.

In an exemplary embodiment, the coating substance is applied covering the surface, at least over the width of a print head 4. In an exemplary embodiment, the coating substance 3 is printed over the entire area on the recording medium 2, or on a defined portion of the print region 6 of the recording medium 2.

In an exemplary embodiment, a raster of active print nozzles 5 of the print head 4 is continuously varied to alternate the active print nozzles 5. The variation of the raster of active print nozzles 5 may be statistically controlled.

In an exemplary embodiment, a proportion of simultaneously activated print nozzles 5 of the print head 4 is in particular at most 80%, preferably at most 75%, particularly preferably at most 50%.

In an exemplary embodiment, a droplet size output by the print nozzles 5 for printing the coating substance 3 is consequently larger than is provided or dimensioned or set given a full-area printing with the same applied quantity of coating substance per area and continuously active print nozzles 5 (as in FIG. 1). This is symbolized in FIG. 2 by the thicker line width of the jets 9 in comparison to FIG. 1.

In an exemplary embodiment, a droplet size output by the print nozzles 5 for printing of the coating substance 3 with the predetermined applied quantity per area is dimensioned such that at most 80%, in particular at most 75%, preferably at most 50% of the print nozzles 5 of the print head 4 are simultaneously required for printing of the predetermined applied quantity per area. The droplets are thus markedly larger than would actually be necessary for printing of the predetermined applied quantity per area. Less simultaneous activity of the print nozzles is required with the comparably large droplet size, such that the activity may be alternated better or more.

In comparison to a full-area printing with the same applied quantity per area and continuously active print nozzles 5 (according to FIG. 1), a print gap 7 between print head 4 and recording medium 2 is provided or dimensioned identically; compare FIGS. 1 and 2.

Figure 3:
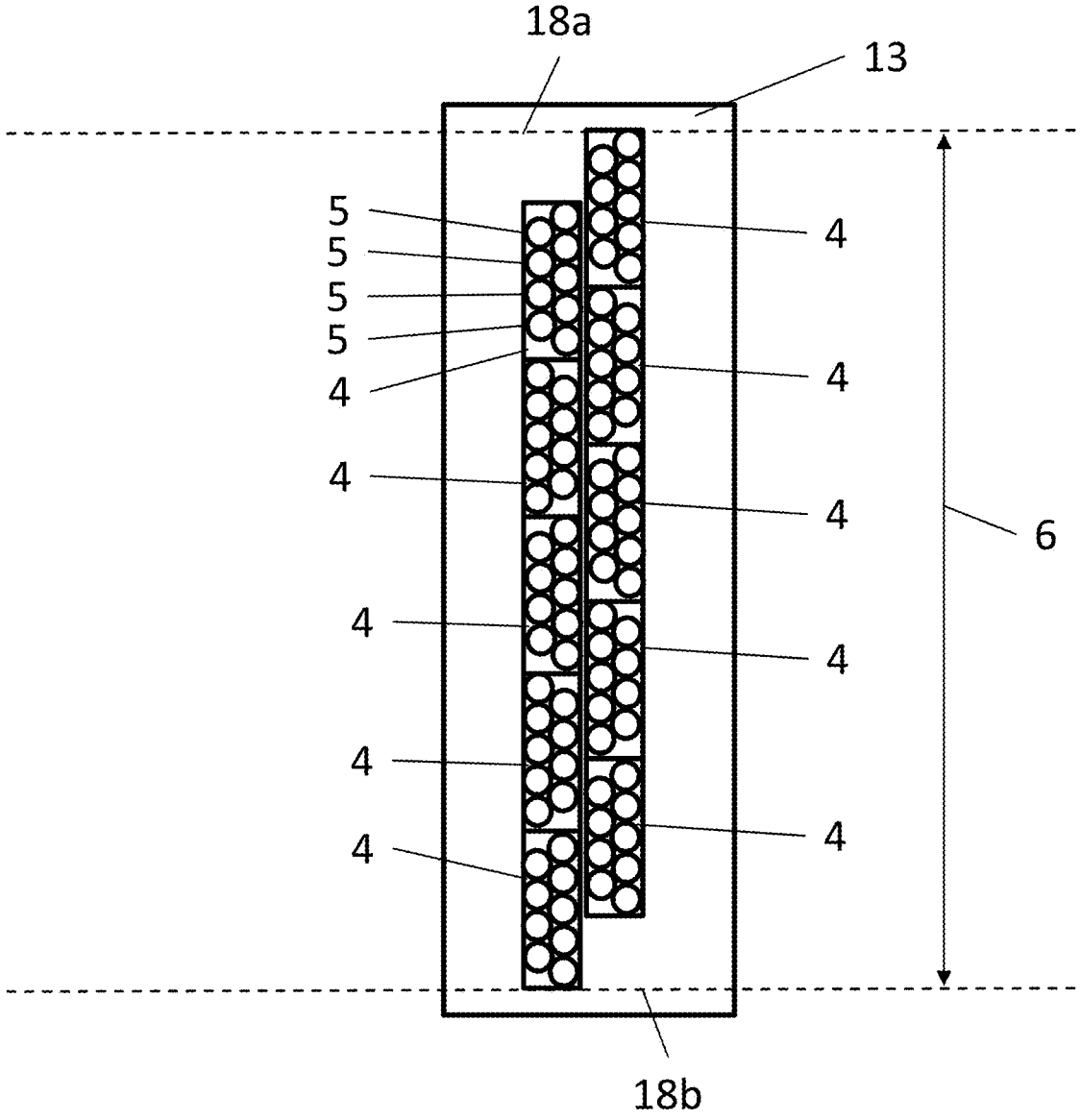
FIG. 3 illustrates a schematic depiction of a nozzle plate side of a primer inkjet printing station according to an exemplary embodiment of the present disclosure.

FIG. 3 shows a schematic depiction of a nozzle plate side of a primer inkjet printing station 13 according to an exemplary embodiment.

In an exemplary embodiment, the primer inkjet printing station 13 has a plurality of print heads 4 arranged side by side, in particular a plurality of offset rows of print heads 4 arranged side by side. The print nozzles 5 of the print heads 4 are configured to be individually addressable by a controller 11 (see FIG. 4) for output of a coating substance.

The primer inkjet printing station 13, which is also referred to as a primer print bar, includes—purely by way of example—two rows of print heads 4 arranged side by side. The two rows are arranged offset from one another. In this way, it is advantageously ensured that a streak-free, surface-covering printing is enabled over the entire width (represented here as an arrow) of the print region 6 of the recording medium 2 symbolized with dashed lines.

The number of print heads 4 may naturally vary depending on their size and depending on the width of a recording medium 2 or of its print region 6. It would also be conceivable to provide only a single print head 4 with the required width, or to design the primer inkjet station 13 with a single print head 4 extending over the width of the print region 6.

In an exemplary embodiment, each of the depicted print heads 4 has a plurality of print nozzles 5. For this, each print head 4 has what is known as a print plate into which the print nozzles 5 are introduced in the form of microscopic openings.

Purely for improved clarity, only nine print nozzles 5 which are arranged side by side in two rows and offset relative to one another are depicted at each of the print heads 4 in the presentation of FIG. 3. Typically, a print head that includes a much greater number than the number of print nozzles 5 shown is provided which have much smaller dimensions, for example in the micrometer range, in comparison to the size of the print head 4. The most varied arrangements of the print nozzles 5 are thereby possible. The dimensions as well as the number and type of the arrangement of the print nozzles 5 are variable in a versatile manner. In an exemplary embodiment, a conventional inkjet print head may be used in the primer inkjet station 13 as long as the print nozzles of such print head are individually addressable.

In an exemplary embodiment, a pitch of the print nozzles 5 relative to one another depends on the type of print heads 4 that are used. The type of print head 4 determines the resolution that can be printed with the primer inkjet station 13.

In an exemplary embodiment, the primer inkjet station 2 is configured with a resolution of 600 dots per inch (dpi), but is not limited thereto. This corresponds to a pitch of two print nozzles of approximately 42.3 μm. The print nozzle pitch is naturally variable or scalable depending on the desired resolution.

Figure 4:
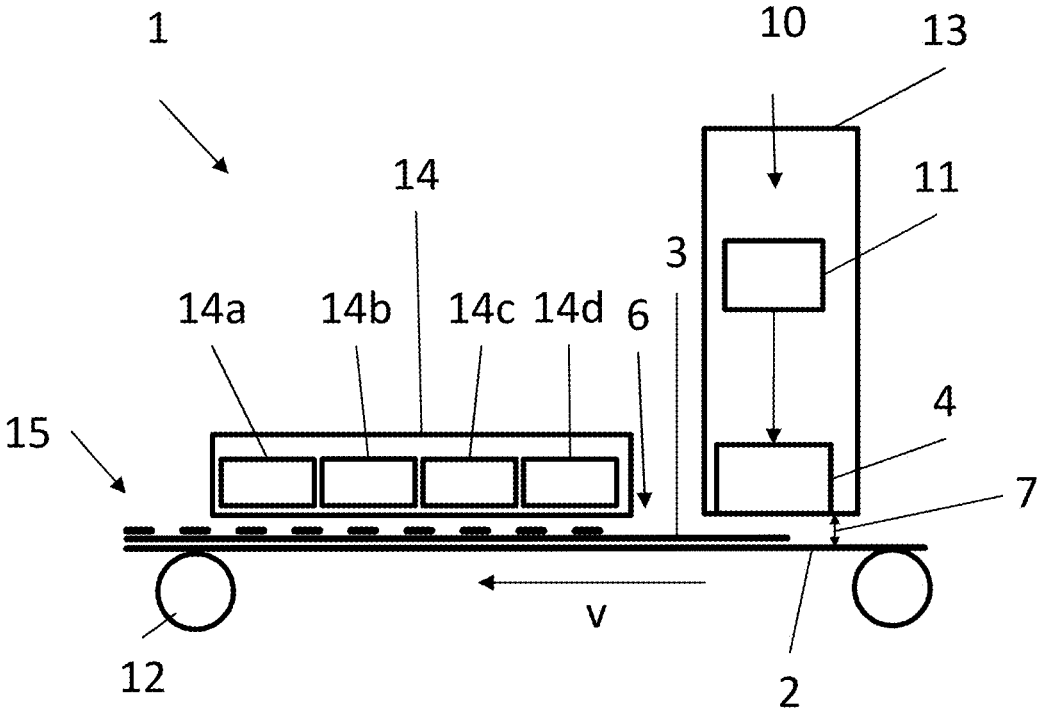
FIG. 4 illustrates a schematic diagram of a printing system according to an exemplary embodiment of the present disclosure.

FIG. 4 shows a schematic depiction of a printing system 1 according to an exemplary embodiment of the present disclosure.

In an exemplary embodiment, the coating substance is continuously applied onto the recording medium 2 (which until this point was dry) by at least one inkjet print head 4. After the application of the coating substance, the recording medium 2 is humidified and, still in the damp state, one of the colored inks is then applied by a plurality of inkjet print heads 14*a* through 14*d*. In this example, the still-dry recording medium 2 (e.g. uncoated paper) first passes the primer print bar 13. Given an uncoated paper, the surface of the paper is unsmoothed and also exposed. Therefore, paper fibers may easily release from the uncoated paper and may deposit as dust on at least one nozzle plates 16 over the printing time. This occurs in particular given full-surface application onto dry recording medium.

In an exemplary embodiment, the printing system 1 is advantageously designed to avoid air vortex formation between a print plate 16 and a paper (e.g. an uncoated paper). In this example, a recording medium 2 is subjected to a surface-covering printing to with a primer as a coating substance 3. Further, the printing system is also additionally provided for subsequent printing with a color print whose quality should be ensured by the primer application.

In an exemplary embodiment, the printing system 1 has a conveyor 12 for continuous conveyance of the recording medium 2 with a predetermined feed velocity v. In an exemplary embodiment, the feed velocity v is above 20 meters per minute, but is not limited thereto. In this way, the recording medium 2 is initially transported to a primer inkjet station 13 for continuous printing to the recording medium 2 with a predetermined applied quantity of primer 3 per area.

The primer inkjet station 13 may be designed according to FIG. 3. For printing to the recording medium 2 with the coating substance, in an exemplary embodiment, the primer inkjet station 13 includes a primer printer 10 that comprises: at least one print head 4 having a plurality of individually addressable print nozzles 5; and a controller 11 configured to control the individual print nozzles 5. As would be understood by one of ordinary skill in the arts, further elements, such as additional print heads and/or other printing systems components, may still be provided, for example, as in the primer inkjet station 13 according to FIG. 3.

In an exemplary embodiment, the controller 11 is configured to control the print nozzles 5 consistent with the operations described with reference to FIG. 2, for surface-covering printing of the coating substance 3 onto the recording medium 2. In an exemplary embodiment, the controller 11 is configured such that: the print nozzles 5 are activated in alternation, only a portion of the print nozzles 5 are simultaneously activated, and a predetermined applied quantity of coating substance 3 per area is constantly printed onto the recording medium 2. As a result, an air vortex formation is advantageously avoided. In an exemplary embodiment, the controller 11 includes processor circuitry that is configured to control the print nozzles 5.

In an exemplary embodiment, following the primer inkjet station 13, the recording medium 2 is conveyed to an inkjet color printing station 14. In an exemplary embodiment, the inkjet color printing station 14 is a conventional YMCK station with four of what are known as color bars 14*a*, 14*b*, 14*c*, 14*d* for the production of the actual print image 15. In principle, every individual color bar 14*a* through 14*d* may be constructed like an inkjet station 13.

Figure 5:
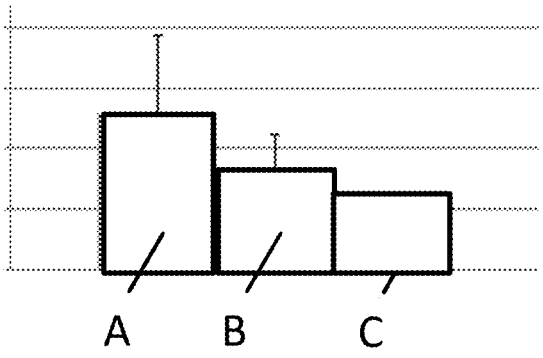
FIG. 5 illustrates a qualitative diagram of the frequency of nozzle failures at a primer inkjet print head for different proportions of simultaneously active print nozzles according to exemplary embodiments of the present disclosure.

FIG. 5 shows a qualitative bar diagram of the frequency of nozzle failures at a primer inkjet print head for different proportions of simultaneously active print nozzles according to exemplary embodiments of the present disclosure.

Three quality measurement bars A, B, C are shown which respectively are provided with a standard deviation, shown as a line extending above the corresponding bar graph segments. The measurement bars respectively represent printing processes with different surface coverage of the same print head 4, which is equivalent to a different number of simultaneously active print nozzles 5.

By contrast, a surface allocation (i.e. an entire applied quantity of the primer per area) is the same for all three bars. The suitable surface allocation essentially depends on the type of recording medium. For example, a typical surface allocation or surface coverage with paper as a recording medium is 2 g/sq. m.

The measurement bar A represents a surface allocation of 100%. Accordingly, all print nozzles 5 of a print head 4 are active, and a smallest possible droplet size TA is set whose volume is used as a reference value for the present disclosure.

The measurement bar B represents a medium surface allocation of 75%, for example. Accordingly, here only 75% of all print nozzles 5 are simultaneously active. Accordingly, a droplet size TB is approximately 44% greater than TA (or is 1.44× TA).

The measurement bar C represents a comparably small surface allocation of 50%, for example. Accordingly, here only 50% of all print nozzles 5 of the print head 4 are simultaneously active. Here the droplet size TC is approximately 118% greater than TA (or is 2.18× TA).

Qualitatively, the measurement bar A with the surface allocation of 100%, meaning with a proportion of 100% simultaneously active print nozzles, has the most nozzle failures given the same applied quantity. With the surface allocation reduced to 75% according to measurement bar B, a qualitative reduction of the nozzle failures by approximately one-third can already be observed. However, the number of nozzle failures drops super-proportionally with the 50% surface coverage in measurement bar C. Here, the number of nozzle failures is qualitatively reduced by approximately three-fourths in comparison to A.

Advantageously, the number of nozzle failures is thus reduced via a novel adaptation of the process parameters and a novel manner of the activation of the print nozzles according to the exemplary embodiments.

Although the present disclosure has been described in the preceding entirely using preferred exemplary embodiments, it is not limited to these, but rather can be modified in numerous ways.

Conclusion

The aforementioned description of the specific embodiments will so fully reveal the general nature of the disclosure that others can, by applying knowledge within the skill of the art, readily modify and/or adapt for various applications such specific embodiments, without undue experimentation, and without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

Embodiments may be implemented in hardware (e.g., circuits), firmware, software, or any combination thereof. Embodiments may also be implemented as instructions stored on a machine-readable medium, which may be read and executed by one or more processors. A machine-readable medium may include any mechanism for storing or transmitting information in a form readable by a machine (e.g., a computer). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact results from computing devices, processors, controllers, or other devices executing the firmware, software, routines, instructions, etc. Further, any of the implementation variations may be carried out by a general purpose computer.

For the purposes of this discussion, the term "processor circuitry" shall be understood to be circuit(s), processor(s), logic, or a combination thereof. A circuit includes an analog circuit, a digital circuit, state machine logic, other structural electronic hardware, or a combination thereof. A processor includes a microprocessor, a digital signal processor (DSP), central processing unit (CPU), application-specific instruction set processor (ASIP), graphics and/or image processor, multi-core processor, or other hardware processor. The processor may be "hard-coded" with instructions to perform corresponding function(s) according to aspects described herein. Alternatively, the processor may access an internal and/or external memory to retrieve instructions stored in the memory, which when executed by the processor, perform the corresponding function(s) associated with the processor, and/or one or more functions and/or operations related to the operation of a component having the processor included therein.

In one or more of the exemplary embodiments described herein, the memory is any well-known volatile and/or non-volatile memory, including, for example, read-only memory (ROM), random access memory (RAM), flash memory, a magnetic storage media, an optical disc, erasable programmable read only memory (EPROM), and programmable read only memory (PROM). The memory can be non-removable, removable, or a combination of both.

REFERENCE LIST

1 printing system
2 recording medium

3 coating substance
4 print head
5 print nozzle
6 print region
7 print column
8 vortex
9 jet
10 primer printer
11 controller
12 conveyor
13 primer inkjet station
14 inkjet color printing station
15 print image
16 print plate
17 underside

The invention claimed is:

1. A method for preventing air vortex formation between a print plate and a recording medium upon printing to the recording medium with a coating substance, the method comprising:

providing the recording medium at a feed velocity of at least 20 meters per minute, the recording medium being uncoated paper; and alternately activating a first subset of print nozzles of a print head and a second subset of the print nozzles of the print head, such that adjacent print nozzles of the print nozzles with respect to a feed direction are not simultaneously activated, to print the coating substance on recording medium to cover a surface of the recording medium with the coating substance, the coating substance being a primer, wherein:

only a portion of the print nozzles are activated simultaneously; and a droplet size of the coating substance being printed on the recording medium is adjusted, based on a proportion of the first subset of print nozzles to total number of print nozzles of the print head, to print a same predetermined applied quantity of the coating substance per area onto the recording medium as would be printed with a simultaneous activation of the total number of print nozzles.

2. The method according to claim 1, wherein the coating substance is applied to cover the surface at least across a width of the print head.

3. The method according to claim 1, wherein the coating substance is printed onto the full surface of the recording medium.

4. The method according to claim 1, wherein the coating substance is printed onto the full surface of a print region of the recording medium.

5. The method according to claim 1, wherein a raster of the print nozzles of the print head that are active is continuously varied.

6. The method according to claim 5, wherein the variation of the raster of the print nozzles that are active is statistically controlled.

7. The method according to claim 1, wherein at most 50% of the print nozzles of the print head are simultaneously activated.

8. The method according to claim 1, wherein the droplet size output by the print nozzles to print the coating substance is larger than a droplet size for a full-surface printing with a same applied quantity per area and continuously active print nozzles.

9. The method according to claim 1, wherein the droplet size output by the print nozzles to print the coating substance with the predetermined applied quantity per area is adjusted such that at most 50% of the print nozzles of the print head are simultaneously required for printing of the predetermined applied quantity per area.

10. The method according to claim 1, wherein a print gap between the print head and the recording medium is provided to be the same in comparison to a full-surface printing with the same applied quantity per area and continuously active print nozzles.

11. The method according to claim 1, wherein the recording medium is a dust-producing recording medium.

12. A non-transitory computer-readable storage medium with an executable program stored thereon, wherein, when executed, the program instructs a processor to perform the method of claim 1.

13. A primer printer for preventing or reducing air vortex formation between a print plate and a recording medium upon printing to the recording medium with a coating substance, the primer printer comprising:

a print head including individually addressable print nozzles; and a controller configured to control the individually addressable print nozzles to alternatively activate a first subset of the print nozzles and a second subset of the print nozzles, such that adjacent print nozzles of the print nozzles with respect to a feed direction are not simultaneously activated, to print the coating substance onto the recording medium to cover a surface of the recording medium with the coating substance, the recording medium being uncoated paper and the coating substance being a primer, wherein:

only a portion of the print nozzles are activated simultaneously, and a droplet size of the coating substance being printed on the recording medium is adjusted, based on a proportion of the first subset of print nozzles to total number of print nozzles of the print head, to print a same predetermined applied quantity of coating substance per area onto the recording medium as would be printed with a simultaneous activation of the total number of print nozzles.

14. A printing system for continuous printing to a recording medium with a primer, the printing system comprising:

a conveyor configured to continuously convey the recording medium with a feed velocity greater than 20 meters per minute, the recording medium being uncoated paper; and a primer inkjet station configured to continuously print to the recording medium with a predetermined applied quantity of the primer per area, the primer inkjet station including a print head having individually addressable print nozzles and a controller configured to alternately activate a first subset of the print nozzles and a second subset of the print nozzles, such that adjacent print nozzles of the print nozzles with respect to a feed direction are not simultaneously activated, to control the plurality of print nozzles to print the primer onto the recording medium to cover a surface of the recording medium with the primer, wherein:

only a portion of the print nozzles are activated simultaneously, and a droplet size of the primer being printed on the recording medium is adjusted, based on a proportion of the first subset of print nozzles to total number of print nozzles of the print head, to print a same predetermined applied quantity of primer per area onto the recording medium as would be printed with a simultaneous activation of the total number of print nozzles.

15. The method according to claim 1, wherein the first subset of print nozzles are even-addressed print nozzles and the second subset of the print nozzles are odd-addressed print nozzles.

16. The method according to claim 1, wherein the first subset of print nozzles and the second subset of print nozzles are alternately activated such that adjacent rows of the print nozzles with respect to the feed direction are not simultaneously activated.

17. The method according to claim 16, wherein the first subset of print nozzles are even-addressed print nozzles and the second subset of the print nozzles are odd-addressed print nozzles.

18. The printing system according to claim 14, wherein the alternate activation of the first subset of the print nozzles and the second subset of the print nozzles, such that adjacent print nozzles of the print nozzles with respect to a feed direction are not simultaneously activated, prevents air vortex formation between the primer inkjet station and the recording medium during upon printing the primer on the recording medium.

19. The method according to claim 1, wherein the adjusting of the droplet size increases the droplet size as compared to a droplet size as would be used to print the coating substance with the simultaneous activation of the total number of print nozzles.

* * * * *